US006497017B2

(12) United States Patent
Yamagishi

(10) Patent No.: US 6,497,017 B2
(45) Date of Patent: Dec. 24, 2002

(54) SLIDER FOR SLIDE FASTENER WITH LOCKING DEVICE

(75) Inventor: Koji Yamagishi, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/893,906

(22) Filed: Jun. 29, 2001

(65) Prior Publication Data

US 2002/0000025 A1 Jan. 3, 2002

(30) Foreign Application Priority Data

Jun. 30, 2000 (JP) ..... 2000-199479

(51) Int. Cl.[7] ..... A44B 19/30
(52) U.S. Cl. ..... 24/421
(58) Field of Search ..... 24/421, 425, 422, 24/420

(56) References Cited

U.S. PATENT DOCUMENTS 4,074,399 A * 2/1978 Kedzierski

FOREIGN PATENT DOCUMENTS

| | | | |
|---|---|---|---|
| DE | 11 55 739 | | 10/1963 |
| EP | 0 251 316 | | 1/1988 |
| EP | 0 832 574 A | | 4/1998 |
| GB | 2017812 A | * | 10/1979 |
| JP | 59-3 8884 | | 10/1984 |

* cited by examiner

*Primary Examiner*—James R. Brittain
(74) *Attorney, Agent, or Firm*—Finnegan, Henderson, Farabow, Garrett & Dunner, L.L.P.

(57) ABSTRACT

The present invention provides a slider with locking device, in which a leaf spring with a locking pawl can be mounted easily on a slider body by press processing. A protruded piece is provided on a rear portion of an upper plate of a slider body and a pawl hole is made near the base portion of the protruded piece. Then, another protruded piece is formed on a front portion of the upper plate and a contact portion is formed on that protruded piece so that an engaging tongue piece of a leaf spring is in contact with the same protruded piece. A groove with an engaged portion is provided in a front face of a guide post of the slider body. The leaf spring is formed in the shape of a substantially fallen letter U and has a locking pawl at one end and a drooping piece at the other end. The drooping piece is provided with an engaging portion which is to be engaged with an engaged portion and the engaging tongue piece is formed in the center of the leaf spring. Then, the leaf spring is engaged with the rear protruded piece and the engaged portion of the guide post so that the engaging tongue piece is always in a press contact with the contact portion.

8 Claims, 7 Drawing Sheets

SLIDER FOR SLIDE FASTENER WITH LOCKING DEVICE

BACKGROUND OF THE INVENTION

1. Field of the Invention

The present invention relates to a slider having a locking mechanism for use in an ordinary type slide fastener and more particularly to a slider for slide fastener with locking device in which slider locking function of a leaf spring with a locking pawl is activated by raising or falling a pull.

2. Description of the Related Art

In a conventional slider for slide fastener having such a locking mechanism disclosed in Japanese Patent Laid-Open Publication No. 10-99107, as shown in FIG. 12, protruded pieces 12', 17' are provided on front and rear portions of an upper plate 4' of a slider body 1' and a cam portion 27' provided on a journal of a pull 3' is mounted between these protruded pieces 12', 17' and then, a leaf spring 2' is disposed on an upper face of the cam portion 27'. The leaf spring 2' is formed in the shape of a substantially fallen letter U and has a locking pawl 8' at one end while it has a drooping piece 9' at the other end. An engaging piece 24' is provided in a central substrate such that it is inclined therefrom and has an engaging portion 25' bent from a front end thereof. The leaf spring 2' has such a configuration that the drooping piece 9' is mounted on a guide post 6' of the slider body 1' and an opening 26' provided in the vicinity of the locking pawl 8' is placed on the protruded piece 17' provided on the rear portion of the upper plate 4' such that it is capable of moving freely. Then, the engaging portion 25' of the engaging piece 24' is placed inside the protruded piece 12' provided on the front portion of the upper plate 4'. When the pull 3' is raised, the engaging portion 25' of the engaging piece 24' can engage with an engaging portion 13' in the protruded piece 12' on the front side portion.

According to Japanese Utility Model Publication No. 59-38884, a pair of pull holding posts are provided protrudedly on the front and rear portions in the center of an upper plate of the body and a journal of a pull is mounted rotatably on the body. A journal of the pull is provided with a cam portion and a leaf spring is placed on the cam portion. The leaf spring is formed in the shape of substantially letter U and has a locking pawl at one end and a drooping portion at the other end. An engaging piece provided at a front end of the drooping portion is engaged with the engaging portion provided in a diamond of the body by snap action and then, a shoulder portion provided in the middle of the leaf spring is fit to a guide surface of a protruded portion on the front portion of the upper plate so that the shoulder portion is capable of swinging along the guide surface.

Because in the slider for slide fastener with locking device shown in FIG. 12 described previously, the leaf spring 2' is mounted on the guide post 6' of the slider body 1' by crimping, a distance between the upper plate 4' and the lower plate 5' joined in the form of substantially letter U with respect to the guide post 6' is enlarged due to deformation of the guide post 6', so that elements cannot be guided accurately between the upper plate 4' and the lower plate 5'. Further, the leaf spring 2' is moved forward of the guide post 6' at the time of crimping so that the mounting position is deviated. As a result, the locking pawl 8' comes into a firm contact with the wall face of the pawl hole thereby disabling the locking pawl 8' from retracting from or advancing to the element guide groove 19'.

Further, because in the slider for slide fastener with locking device according to the Japanese Utility Model Publication No. 59-38884, the shoulder portion of the leaf spring is moved with a circular trace in the vertical direction and back/forth direction along a guide surface accompanied by a rising motion of the pull, the shoulder portion rides over the guide surface when it is moved forward, so that when the pull is fallen, the leaf spring does not follow that motion and is not returned to its original position.

SUMMARY OF THE INVENTION

The present invention has been achieved in views of the above described problems and an object of the present invention is to provide a slider for slide fastener with locking device, wherein when mounting a leaf spring with a locking pawl on a slider body, the leaf spring is mounted not by crimping but by just pressing in snap action, thereby maintaining a stabilized condition for a long term and allowing a smooth sliding operation.

Another object of the invention is to provide a slider for slide fastener with locking device, wherein the leaf spring is prevented from floating from the slider body thereby always maintaining a stabilized condition of the leaf spring.

Another object of invention is to provide a slider for slide fastener with locking device, wherein the leaf spring with the locking pawl is mounted by pressing and the configurations of the protruded piece to be provided on the slider body and the engaging tongue piece to be provided in the leaf spring are specified in order to always maintain a stabilized condition of the same slider for a long term, the same slider for slide fastener being allowed to be modified in various types.

Another object of the invention is to provide a slider for slide fastener with locking device which allows the locking pawl of the leaf spring to retract from or advance to an element guide groove smoothly.

To achieve the above described object, according to the invention, there is provided a slider for slide fastener with locking device wherein a hook-like protruded piece is provided on a rear portion of an upper plate of a slider body and a pawl hole is provided in a base portion thereof; a protruded piece or a through hole is provided in a front portion of the upper plate and a contact portion is formed on this protruded piece or through hole to be in contact with an engaging tongue piece of a leaf spring; a concave groove is provided in a front face of a guide post of the slider body and an engaged portion, which is to be engaged with an engaging piece of the leaf spring, is provided in this groove; the leaf spring is formed in the shape of a substantially fallen letter U and includes a locking pawl at one end thereof and a drooping piece at the other end while this drooping piece has an engaging portion to be engaged with the engaged portion in the groove; and the engaging tongue piece is provided in a central substrate such that it is extended therefrom downwardly in a curved state.

With the above structure, a hooking hole is provided in the vicinity of the locking pawl and the hooking hole is engaged with the protruded piece provided on a rear portion of the upper plate freely movably; the engaging portion provided on the drooping piece is engaged with the engaged portion in the groove; the engaging tongue piece of the leaf spring is mounted on the upper plate such that it is always in a sliding contact with the contact portion; and a journal with a cam portion of a pull is disposed between the rear protruded piece and the engaging tongue piece of the leaf spring.

Consequently, instead of mounting the leaf spring on the slider body by crimping, after placing the pull on the slider body, the leaf spring can be mounted easily by just pressing against the slider body. Further, because the engaging tongue piece is always in a press contact with the contact face, the leaf spring can maintain a stabilized condition, thereby ensuring a smooth sliding operation of the slider.

Preferably, the protruded piece is provided in the front portion of the upper plate of the slider body in the form of a hook and an engaging protrusion is provided protrudedly in the center of a distal end of the protruded piece while the distal end of the protruded piece at both sides of the engaging protrusion is formed as the contact portions; a through hole is provided in the engaging tongue piece extended as bent from a central substrate of the leaf spring and the through hole is loosely engaged with the engaging protrusion of the protruded piece so that the surface of the engaging tongue piece is always in a press contact with the contact portion provided in the protruded piece.

Consequently, the protruded piece restricts the leaf spring from floating over the slider body and the engaging tongue piece always maintains a stabilized condition.

Preferably, the protruded piece is provided on the front portion of the upper plate of the slider body and a distal end of the protruded piece or a base portion of the protruded piece is formed as the contact portion so that the engaging tongue piece provided in the leaf spring is always in a press contact with the contact portion.

Also preferably, the through hole is provided in the front portion of the upper plate of the slider body and a wall face of the through hole is formed as the contact portion so that the engaging tongue piece provided in the leaf spring is always in a press contact with the contact portion.

Further preferably, a surface or a front end of the engaging tongue piece provided in the leaf spring is always in a press contact with the contact portion provided on the upper plate of the slider body.

Consequently, in combination of various type contact portions and the engaging tongue piece, the engaging tongue piece of the leaf spring can be always in a press contact with the contact portion provided on the upper plate and can slide. Further, the leaf spring can be mounted in a stabilized condition by a simple process of pressing. As a result, a slider for slide fastener with locking device ensuring an easy operation and excellent durability is produced.

And preferably, the contact portion provided on the upper plate of the slider body is formed with a vertical plane substantially at right angle with respect to a top face of the upper plate.

Consequently, in addition to the effect of the first aspect, the engaging tongue piece never rides over the contact portion, so that the engaging tongue piece can move smoothly and the locking pawl can retract from or advance to the element guide groove in a stabilized condition for a long term. Therefore, the effects which the present invention achieves are conspicuous.

DESCRIPTION OF THE PREFERRED EMBODIMENTS

Figure 1:
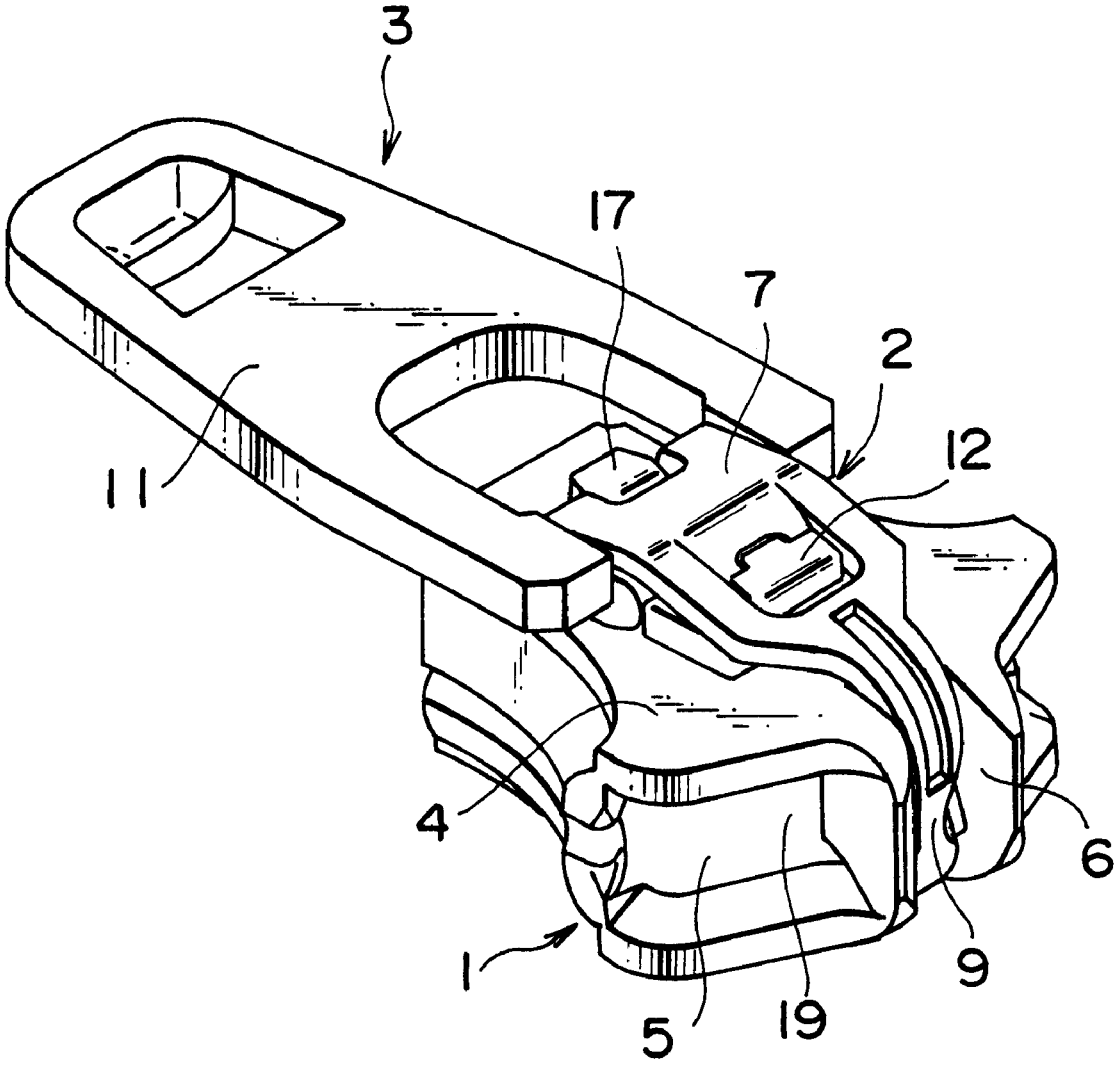
FIG. 1 is a perspective view of a slider for slide fastener with locking device according to a first embodiment of the invention.
Figure 2:
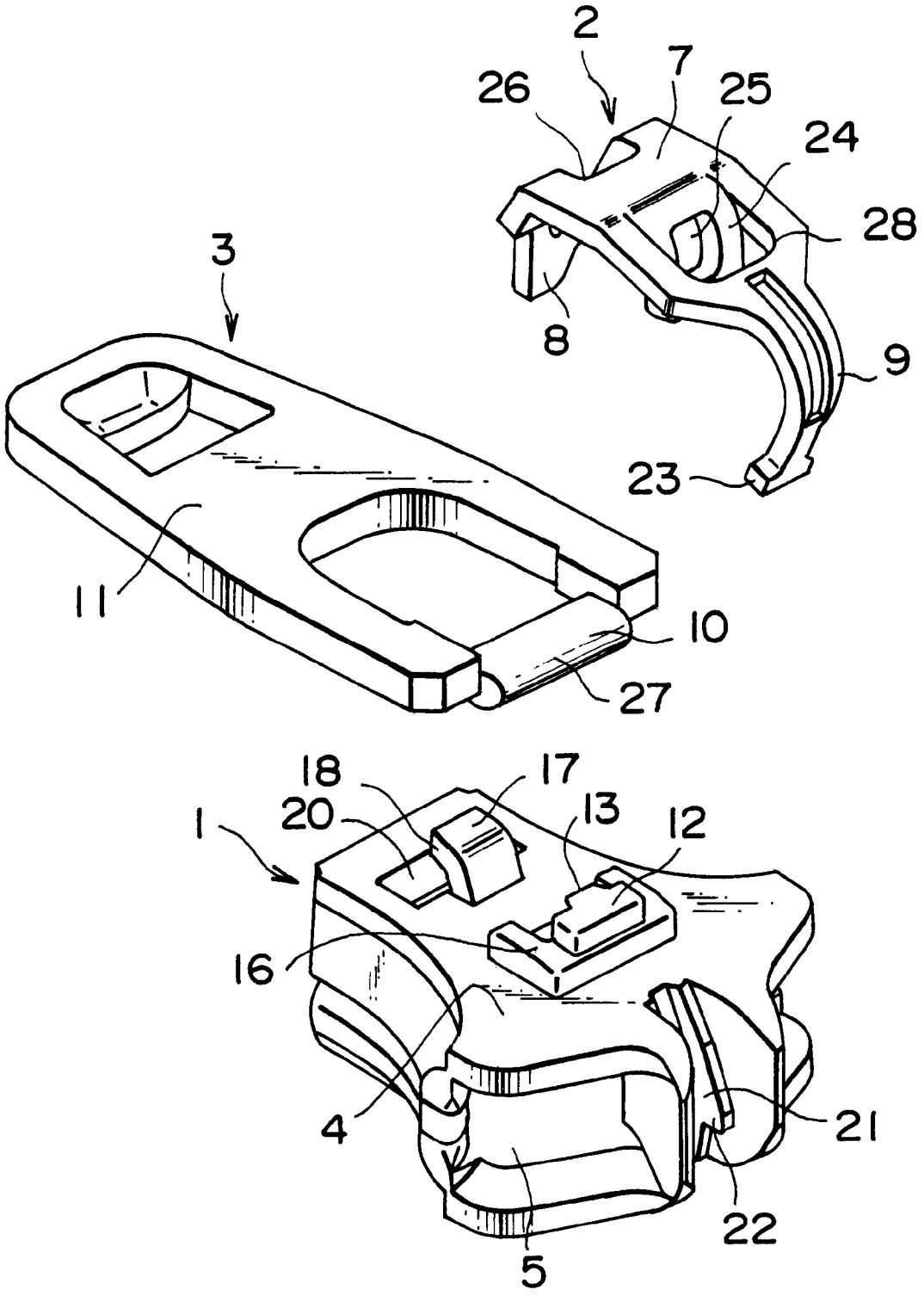
FIG. 2 is an exploded perspective view of the same slider.
Figure 3:
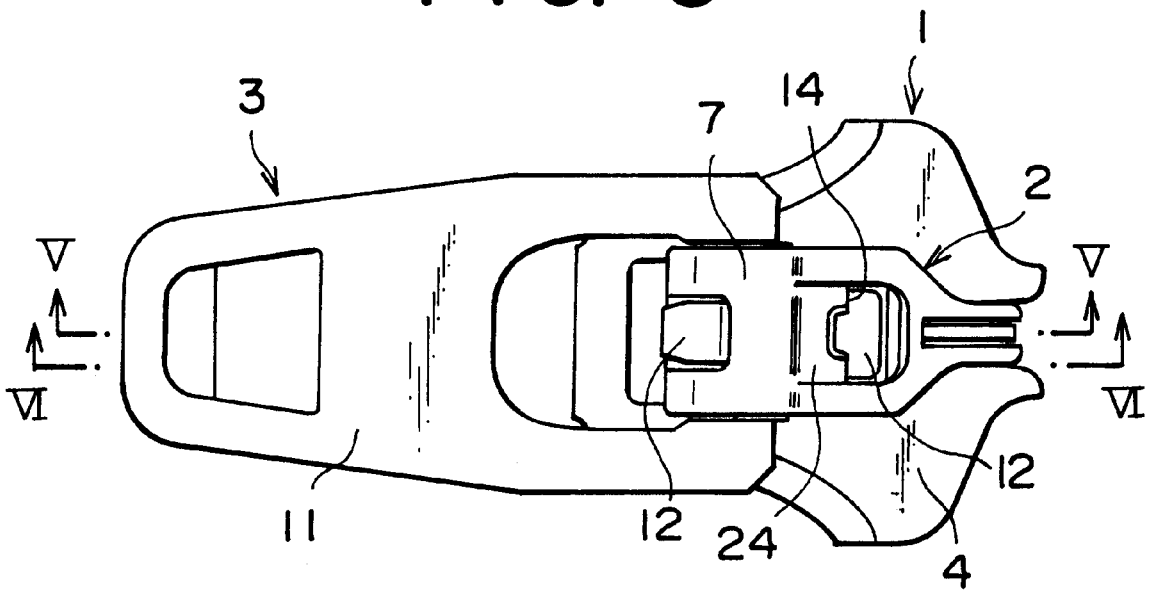
FIG. 3 is a plan view of the same slider.
Figure 4:
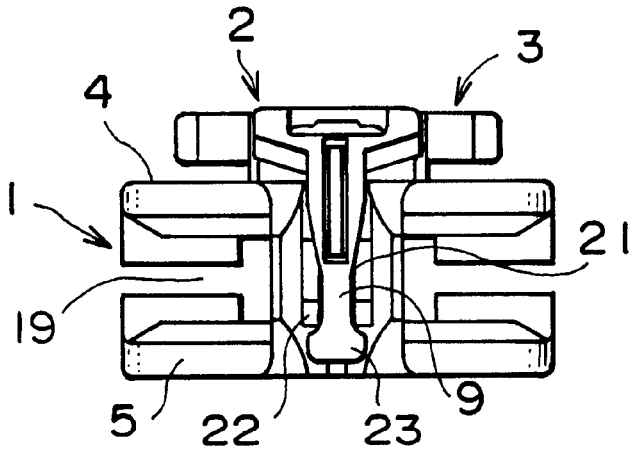
FIG. 4 is a front view of the same slider.

Hereinafter, preferred embodiments of the slide fastener slide with locking device of the present invention will be described in detail with reference to the accompanying drawings.

The slide fastener slide with locking device of the present invention is an ordinary type slider having locking mechanism as shown in FIGS. 1 to 4 and the slider comprises a body 1, a leaf spring 2 and a pull 3. These components are produced by sheet metal processing means.

The body 1 of the slider is comprised of an upper plate 4, a lower plate 5 and a guide post 6 for joining the upper blade plate 4 with the lower blade plate 5. The leaf spring 2 is in the form of a sheet while both ends are bent. A substrate 7 is formed in the center of the leaf spring 2 and a locking pawl 8 is formed on one end thereof while a drooping piece 9 is formed on the other end thereof. The pull 3 has a journal 10 which is to be mounted on the body 1 rotatably, provided on one end thereof and a grip portion 11 is formed on the other end thereof.

Further, the body 1 has a protruded piece 12 which is protruded in the shape of a hook at a front side portion or center on a shoulder side of the upper plate 4. This protruded piece 12 has an engaging protrusion 13 protruded in the center of a distal end thereof, so that a through hole 25 in an engaging tongue piece 24 of the leaf spring 2, which will be described later, engages with this protrusion 12. A contact portion 14 is formed on the distal ends of the protruded piece 12 on both sides of the engaging protrusion 13 so that it is capable of making contact with the engaging tongue piece 24. The contact portion 14 is formed on a vertical plane with respect to an upper face of the upper plate 4, which an extended line of the same contact portion 14 intersects at right angle. A through hole 15, which leads to an element guide groove 19, is provided in a base portion of the protruded piece 12 and supporting bases 16 are provided on both sides of the base portion of the protruded piece 12 so as to support the leaf spring 2 tilted forward.

A hook-like protruded piece 17 is provided on a rear portion or in the center of a rear mouth side of the upper plate 4 such that it is tilted backward. An engaging portion 18 is formed by bending a distal end of the protruded piece 17 so that a hooking hole 26 in the leaf spring 2 is engaged with this protruded piece 17 freely movably. A pawl hole 20, which leads to the element guide groove 19, is provided next to the base portion of the protruded piece 17. Further, a groove 21 is provided in a front face of the guide post 6 and a substantially right-angled triangle shaped engaged portion 22, in which a lower portion thereof is horizontal while an upper portion thereof is inclined so as to engage with an engaging portion 23 of the leaf spring 2, is formed on both sides of this groove 21. In the meantime, the groove 21 may be of a vertical hole going through the guide post 6 vertically as well as of concave shape shown in the Figure.

The leaf spring 2 is formed in the shape of substantially fallen letter U and has the locking pawl 8 on one end thereof and the narrow drooping piece 9 on the other end. This drooping piece 9 has the engaging portion 23 which is provided on a front end thereof such that it extends laterally to both sides, the engaging portion 23 engaging with the engaged portion 22 provided in the guide post 6. An opening 28 is provided in the central substrate 7 of the leaf spring 2 and, the engaging tongue piece 24 is provided such that it extends forward from an edge of the opening 28 in a condition that it is curved downward. The through hole 25 is made in the center of this engaging tongue piece 24 so that the engaging protrusion 13 of the protruded piece 12 is capable of engaging with this through hole 25 freely movably. Further, the hooking hole 26, with which the rear protruded piece 17 is capable of engaging freely movably, is made in the leaf spring 2 in the vicinity of the locking pawl 8 so as to restrict the locking pawl 8 from rising.

The pull 3 has the journal 10 at one end and the grip portion 11 at the other end thereof. On the journal 10 is formed a cam portion 27, which is formed so as to project eccentrically to a side opposing the body 1 when the pull 3 is mounted on the body 1 and fallen and whose section provides a rectangular shape extended along the length direction of the pull 3, and when the pull 3 is mounted on the body 1 and raised, the leaf spring 2 is brought up.

Figure 5:
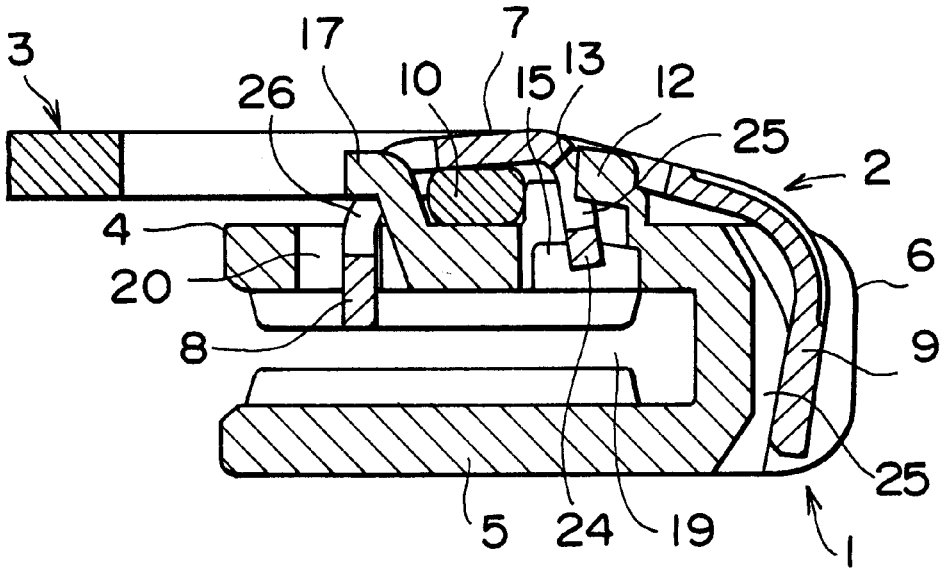
FIG. 5 is a sectional view taken along the line V—V of FIG. 3.

Assembly of the slider having the locking mechanism will be described. First, the pull 3 is mounted on the upper plate 4 of the body 1 such that the cam portion 27 provided on the journal 10 of the pull 3 is accommodated between the front and rear protruded pieces 12 and 17 on the upper plate 4. Then, the leaf spring 2 is disposed on the pull 3, namely as shown in FIG. 5, the locking pawl 8 is inserted into the pawl hole 20 in the upper plate 4 and the protruded piece 17 is engaged with the hooking hole 26 freely movably, so that a mouth edge of the hooking hole 26 is caught by the engaging portion 18 of the protruded piece 17.

Figure 6:
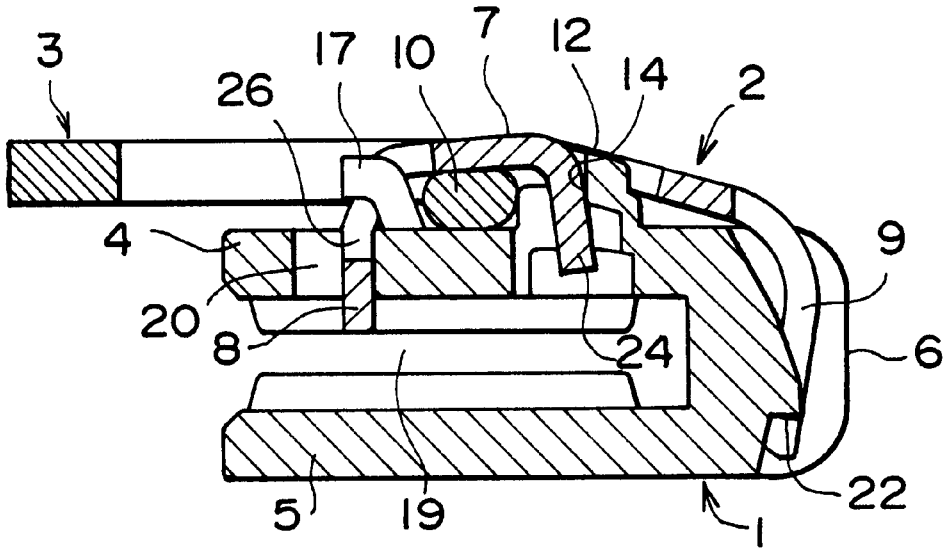
FIG. 6 is a sectional view taken along the line VI—VI of FIG. 3.

The protruded piece 12 is inserted into the opening 28 provided in the front portion of the substrate 7 of the leaf spring 2 and at the same time, the engaging tongue piece 24 of the leaf spring 2 is inserted into the through hole 15 provided below the protruded piece 12 so that the engaging protrusion 13 of the protruded piece 12 is engaged with the through hole 25 in the engaging tongue piece 24. Further, as shown in FIG. 6, the side edges of the leaf spring 2 are placed on the supporting base 16 on the upper plate 4 such that a surface of the engaging tongue piece 24 is pressed against the contact portion 14 provided on the protruded piece 12.

Further, by pressing down the front end of the drooping piece 9 provided at the front end of the leaf spring 2 along a slope above the engaged portions 22 on both sides of the groove 21 provided in the guide post 6 in the body 1, the engaging portion 23 engages with the engaged portion 22 by means of elasticity of the drooping piece 9, so that the slider is assembled.

Figure 7:
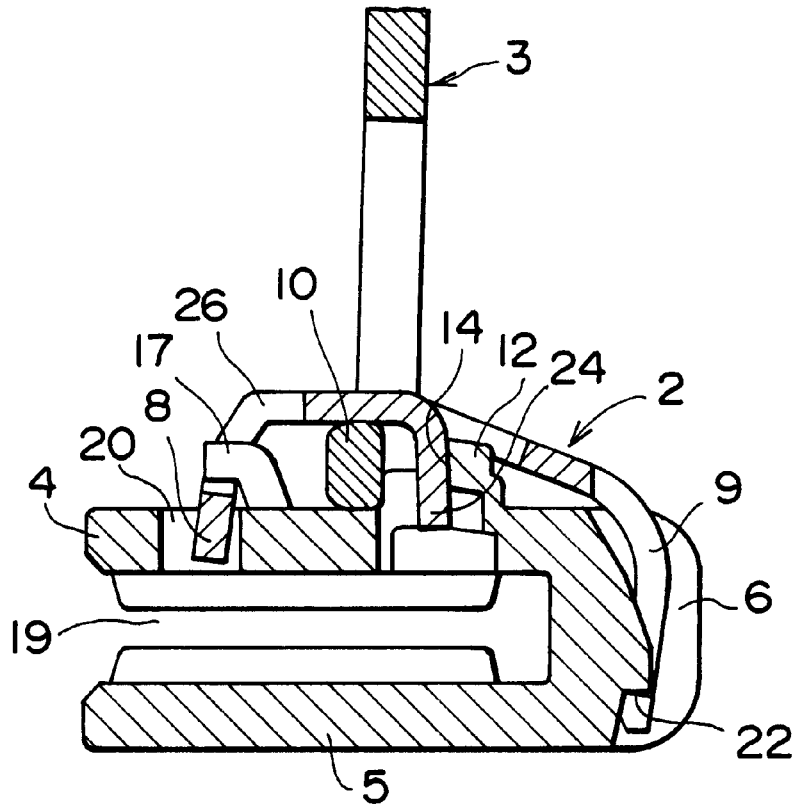
FIG. 7 is a sectional view of the same slider when a pull thereof is raised.
Figure 8:
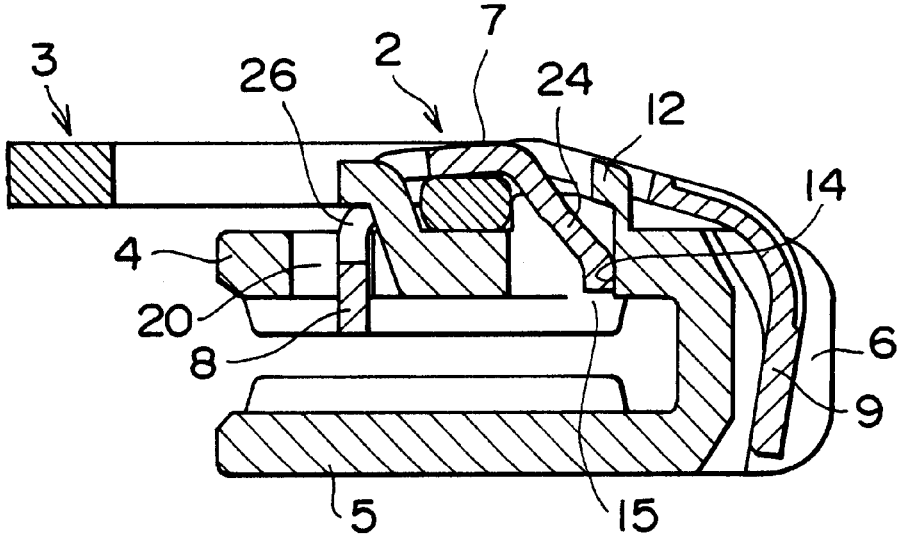
FIG. 8 is a sectional view of a slider according to a second embodiment of the present invention.

In the assembled slider having the locking mechanism, if the pull 3 is raised as shown in FIG. 7, the leaf spring 2 is lifted up resisting elasticity thereof by the cam portion 27 of the pull 3, so that the locking pawl 8 is retracted from the element guide groove 19, thereby allowing the slider to slide freely. If the pull 3 is fallen to its original position, the locking pawl 8 projects into the element guide groove 19, so that it is inserted between elements thereby locking the slider motion. If the pull 3 is fallen forward of the body 1, the leaf spring 2 is lifted up and maintained in that state by the eccentrically formed cam portion 27, the slider is capable of sliding forward freely.

A slider for slide fastener with locking device according to a second embodiment of the present invention will be described. The slider of the second embodiment is different from that of the first embodiment in the configurations of the contact portion 14 formed on the protruded piece 12 on the front portion of the body 1 and the engaging tongue piece 24 formed in the leaf spring 2. That is, the protruded piece 12 is provided on the front portion of the upper plate 4 in the form of a hook and the through hole 15 leading to the element guide groove 19 is made in the base portion on the inner side of this protruded piece 12. Then, a front vertical wall face of this through hole 15 is formed as the contact portion 14. The engaging tongue piece 24 in the central substrate 7 of the leaf spring 2 is formed to be inclined gently forward. Consequently, the surface of the front end of the engaging tongue piece 24 is always pressed against the contact portion 14.

Figure 9:
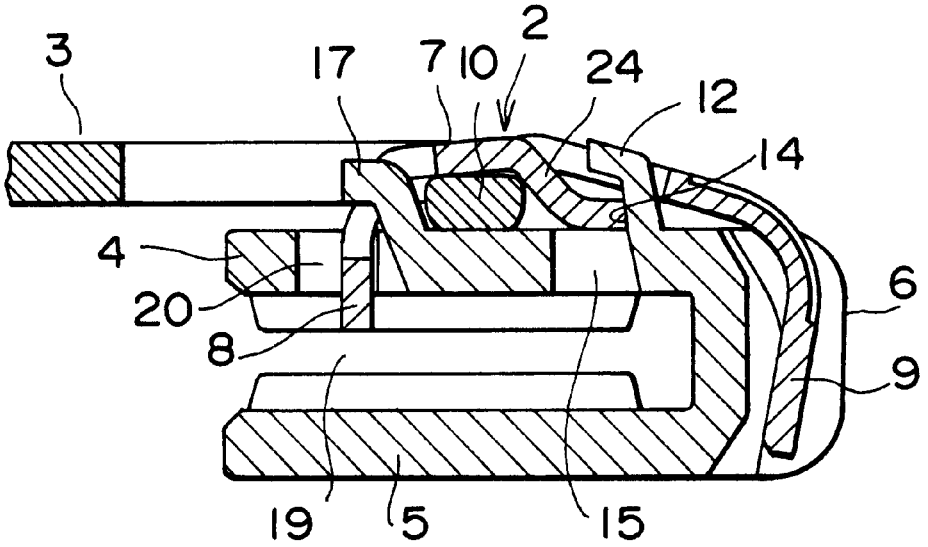
FIG. 9 is a sectional view of a slider according to a third embodiment of the present invention.

In a slide fastener slide with locking device according to a third embodiment of the present invention, as shown in FIG. 9, the hook-like protrusion 12 is provided on the front portion of the body 1 such that it is slightly inclined backward and the contact portion 14 is formed on a substantially vertical side face of a base portion of the protrusion 12. The engaging tongue piece 24 is provided in the central substrate 7 of the leaf spring 2 such that it is gently inclined forward. A front end of the engaging tongue piece 24 is bent horizontally so as to be always pressed against the contact portion 14 formed on the base portion of the protruded piece 12.

Figure 10:
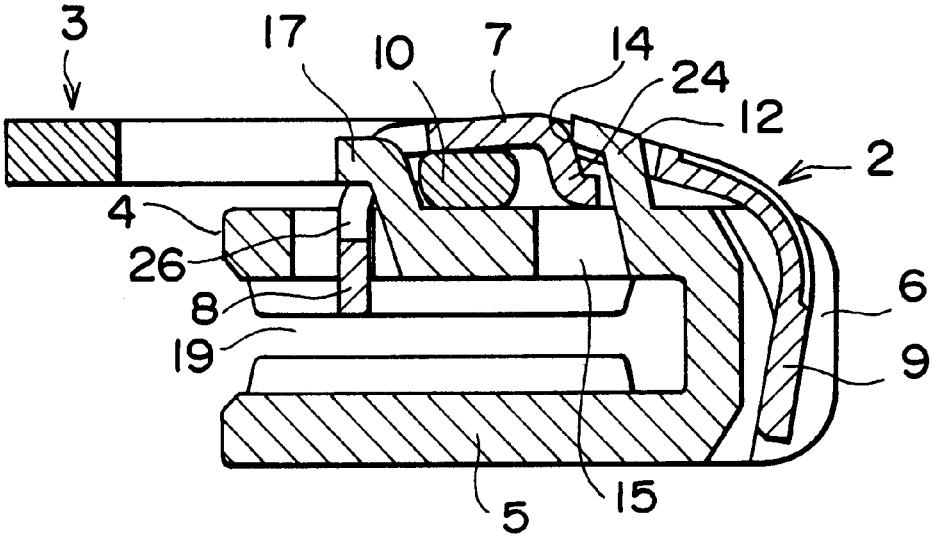
FIG. 10 is a sectional view of a slider according to a fourth embodiment of the present invention.

In a slide fastener slider with locking device according to a fourth embodiment of the present invention, as shown in FIG. 10, the hook-like protrusion 12 is provided on the front portion of the body 1 such that it is slightly inclined backward and a distal end of the protruded piece 12 is bent horizontally. A vertical end face at the distal end of this protruded piece 12 is formed as the contact portion 14. The engaging tongue piece 24 provided in the central substrate 7 of the leaf spring 2 is bent substantially at right angle with a front end thereof being bent horizontally, so that the surface of the engaging tongue piece 24 is always in a sliding contact with the contact portion 14 formed on the distal end of the protruded piece 12.

Figure 11:
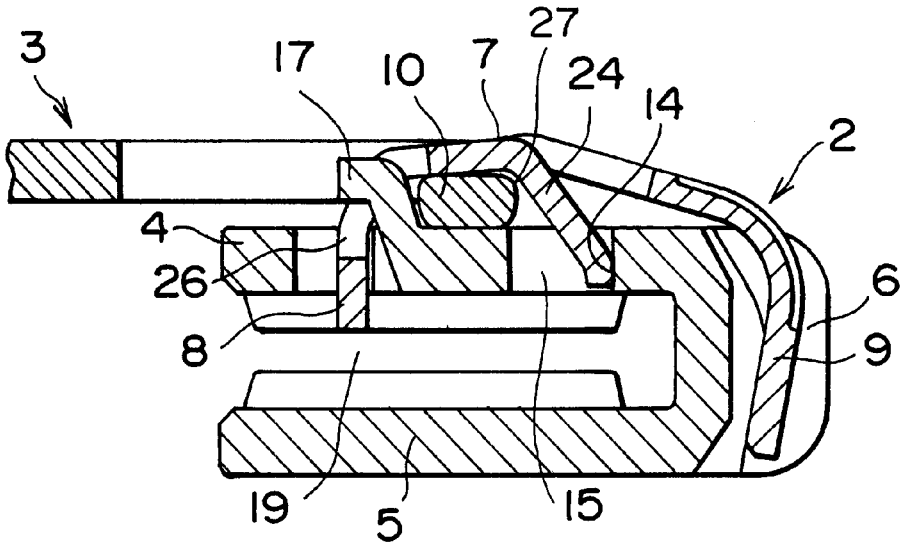
FIG. 11 is a sectional view of a slider according to a fifth embodiment of the present invention.
Figure 12:
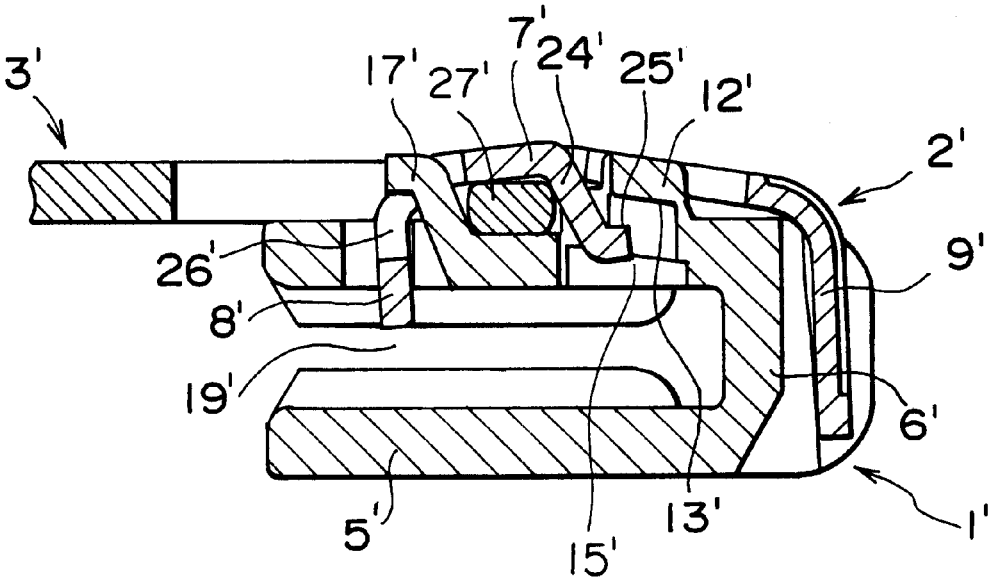
FIG. 12 PRIOR ART
FIG. 12 is a sectional view of a well known slider.

In a slide fastener with locking device according to a fifth embodiment shown in FIG. 11, the through hole 15 is formed in the upper plate 4 without the protruded piece 12 being provided on the front portion of the body 1 and a front vertical face of this through hole 15 is formed as the contact portion 14. The engaging tongue piece 24 provided in the central substrate 7 of the leaf spring 2 is bent such that it is gently inclined forward so that a front end thereof is always in a sliding contact with the contact portion 14 provided on the wall face of the through hole 15. In the meantime, because the slider of this embodiment has no protruded piece 12 on the front portion of the upper plate 4, the cam portion 27 provided on the journal 10 of the pull 3 is placed between the rear protruded piece 17 and the engaging tongue piece 24.

What is claimed is:

1. A slider for slide fastener with locking device, wherein a protruded piece is provided on a rear portion of an upper plate of a body and a pawl hole is provided; a contact portion is formed on a front portion of the upper plate by a protruded piece or a through hole; a groove with an engaged portion is provided in a front face of a guide post; a leaf spring is formed in the shape of a substantially fallen letter U and comprises a locking pawl at one end thereof and a drooping piece with an engaging portion at the other end while an engaging tongue piece is provided in a central substrate such that it is extended therefrom in a curved state; a hooking hole provided in the vicinity of the locking pawl is engaged with the rear protruded piece freely movably; the engaging portion of the drooping piece is engaged with the engaged portion; the engaging tongue piece is mounted such that it is always in a sliding contact with the contact portion; and a journal with a cam portion of a pull is disposed between the rear protruded piece and the engaging tongue piece.

2. A slider for slide fastener with locking device according to claim 1, wherein the protruded piece is provided on the front portion of the upper plate in the form of a hook and an engaging protrusion is provided protrudedly in the center of a distal end of the protruded piece while the distal end of the protruded piece at both sides of the engaging protrusion are formed as the contact portions; a through hole is provided in the engaging tongue piece extended to be bent from the central substrate of the leaf spring and the through hole is loosely engaged with the engaging protrusion so that the surface of the engaging tongue piece is always in a press contact with the contact portion.

3. A slider for slide fastener with locking device according to claim 1, wherein the protruded piece is provided on the front portion of the upper plate and a distal end of the protruded piece is formed as the contact portion so that the engaging tongue piece is always in a press contact with the contact portion.

4. A slider for slide fastener with locking device according to claim 1, wherein the protruded piece is provided on the front portion of the upper plate and a base portion of the protruded piece is formed as the contact portion so that the engaging tongue piece is always in a press contact with the contact portion.

5. A slider for slide fastener with locking device according to claim 1, wherein the through hole is provided in the front portion of the upper plate so as to form the contact portion so that the engaging tongue piece is always in a press contact with the contact portion.

6. A slider for slide fastener with locking device according to claim 1, wherein a surface of the engaging tongue piece is always in a press contact with the contact portion.

7. A slider for slide fastener with locking device according to claim 1, wherein a front end of the engaging tongue piece is always in a press contact with the contact portion.

8. A slider for slide fastener with locking device according to claim 1, wherein the contact portion is formed with a vertical plane substantially at right angle with respect to a top face of the upper plate.

* * * * *